United States Patent [19]

Loersch et al.

[11] 4,432,220

[45] Feb. 21, 1984

[54] SHOT PEENING APPARATUS

[75] Inventors: Joseph F. Loersch, Bolton; James W. Neal, Columbia, both of Conn.

[73] Assignee: United Technologies Corporation, Hartford, Conn.

[21] Appl. No.: 300,726

[22] Filed: Sep. 10, 1981

[51] Int. Cl.[3] ..... B21J 5/00

[52] U.S. Cl. ..... 72/53

[58] Field of Search ..... 72/53, 40; 51/428, 431

[56] References Cited

U.S. PATENT DOCUMENTS

| | | | |
|---|---|---|---|
| 937,180 | 10/1909 | Ridd . | |
| 2,881,506 | 4/1959 | Fuchs | 29/90 |
| 3,019,522 | 2/1962 | Bluth | 72/53 |
| 3,423,976 | 1/1969 | Burney | 72/53 |
| 3,624,967 | 12/1971 | Camper | 72/53 |
| 3,705,511 | 12/1972 | Brandel et al. | 72/53 |
| 4,067,240 | 1/1978 | Straub | 72/377 |

FOREIGN PATENT DOCUMENTS

| | | | |
|---|---|---|---|
| 143742 | 9/1980 | Fed. Rep. of Germany | 51/428 |

OTHER PUBLICATIONS

ASM "Shot Peening" Metals Handbook, vol. 2, pp. 398–405 (1964), Amer. Soc. for Metals.

Pangborn Corp. "Shot Peening" (circa. 1961) (Propulsion of Shot Section and Peening Equip. Section).

Brandel, Klass, "Ball Forming Solves . . . Problems", Metal Progress (Mar. 1971).

*Primary Examiner*—Gene Crosby

*Attorney, Agent, or Firm*—C. G. Nessler

[57] ABSTRACT

In apparatus for shot peening, gravity is used to accelerate uniform sized steel shot, and thereby impart a combination of good surface finish and uniform compressive stresses to workpieces. It is especially useful for finishing gas turbine airfoils. Shot is introduced into the peening enclosure (28) through a gate (40) at near zero velocity. It is then accelerated along a streamline (31) toward the workpiece (18) with uniform velocity. The workpiece, positioned along the streamline, can be manipulated in three rotational modes: oscillatory rotation to uniformly peen contoured surfaces of a workpiece, periodic incremental rotation to peen different sides of a workpiece; and, tilting motion to enable peening of shoulders (22). The apparatus is especially suited to peening fragile workpieces such as gas turbine airfoils (18). A diverter plate (44) intercepts the shot stream at times when repositioning of a fragile workpiece is undertaken. Thus, possibly damaging impacts are avoided and steady state operation is able to be promptly resumed.

12 Claims, 11 Drawing Figures

SHOT PEENING APPARATUS

DESCRIPTION

Technical Field

The invention relates to shot peening apparatus, most particularly, apparatus in which the shot particles are accelerated by gravity.

Background

The present invention is concerned with imparting residual surface stresses and a controlled surface texture or finish to workpieces on a production basis. Of particular interest is the providing of good finishes and compressive surface stresses on workpieces such as the airfoil for a gas turbine engine shown in FIG. 1. Typically, such airfoils have a curved surface 20, thin edges, 19, 19', and shoulders 26, also called platforms. Airfoils cannot be readily and uniformly peened unless they are disposed properly with respect to the shot stream. Shot particles must hit the workpiece surfaces at a high impingement angle to be effective. Heretofore, airfoil workpieces have primarily been peened in pneumatic or impeller type machines. Such machines are not adapted to provide the uniform shot velocities necessary to obtain the surface finishes disclosed in our copending applications. However especially in the case of the pneumatic machines, the shot can be directed at the workpiece at a variety of different directions and in this sense they are superior.

Gravity peening is a method whereby the shot is allowed to fall freely under gravitational acceleration. An early machine for shot peening by gravity was disclosed by Ridd in U.S. Pat. No. 937,180. Steel balls are dropped from funnel shaped openings and the flow is controlled by a sliding cover at the base of the openings. Straub in U.S. Pat. No. 4,067,240 discloses a somewhat similar apparatus wherein a constant level of shot in the funnel shaped structure is maintained with the aid of an overflow tube. Brandel et al in U.S. Pat. No. 3,705,511 discloses an apparatus where, after being elevated to a height, the shot rolls down an inclined plane, and is discharged from the edge thereof, to fall freely onto the workpiece.

Of course, a mass of balls in a hopper will behave somewhat analogously to a liquid. Therefore in funnel shaped hoppers the discharge velocity of a shot particle will be dependent on the size and height of the balls in the funnel. When the funnel is dispensed with, as in Brandel et al, the use of an inclined plane gives a significant horizontal component to the shot, and it therefore drops along a curvilinear path. In the method of the present invention, the direction and velocity of the balls must be more closely controlled than attainable with the prior art apparatus. Furthermore, all the prior art gravity peening apparatus appears to be suited and applied to only peening of flat sheets. When it is sought to uniformly peen more complex shapes, such as gas turbine airfoils, improved apparatus is required. They will not be peened and surface finished to the needed precision if they are simply inserted in static positions in the apparatus of the prior art.

Summary of the Invention

An object of the invention is to provide a means for imparting both uniform compressive stresses and smooth surface finishes to workpieces, especially to those having irregular and relatively fragile configurations, such as gas turbine airfoils have.

According to the invention a substantially collimated shot stream is introduced within an enclosure by discharging the shot first at a very low and uniform initial velocity and then accelerating the shot to a uniform higher velocity by gravity acceleration. After impacting the workpiece, the shot falls to the bottom of the enclosure, where it is collected and returned to the original entry point.

The shot is introduced through a gate which attenuates any velocity of the returned shot and provides the desired low initial vertical velocity. Preferably the gate is a perforated flat plate which imparts to the shot, issuing from the multiple discharge points therein, a small lateral velocity component. Thus, a uniform pattern of shot is provided a short distance beneath the plate, in a workpiece holding zone, and workpieces may be positioned anywhere in a lateral planes within the uniform shot stream, and receive consistent peening. The preferred gates which achieve the precise velocity parameters and uniform distribution are perforated plates. In one embodiment the apparatus is provided with means for maintaining a constant head over a single plate, in a range which provides a uniform mass flow rate. In another embodiment, a series of offset perforated plates are configured to constitute a labyrinth through which the shot must flow. Both types of gates are found to provide consistent and low initial velocities. These, in combination with closely sized shot having a mean diameter in the range 1–2.5 mm, enable energies uniform within about ±25% to be achieved at the workpiece. Such uniformity is believed not achieved heretofore, and is necessary to achieve smooth surfaces, of the order of 30 AA (Arithmetic Average) or better, in combination with compressive stressing to depths of the order of 0.13 mm or more.

The velocity at the workpiece surface is dependent on the height through which the shot drops, and this may be varied by repositioning the gate vertically. The initial vertical velocities provided by the gate are small, as indicated, and are about 1–3% of the typical impact velocities. The apparatus provides impact velocities in the range 2.5–12 meter per second, and the velocities are uniform within about at least about ±4%. The lateral initial velocity component, although necessary, is small, of the order of 0.1 m/sec. Thus, it is a negligible fraction of the vertical velocity on impact with the workpiece, and the shot travels along a substantially collimated streamline path, which enables precise peening on workpieces which have contours, fragile portions, or zones which need special care to obtain uniform surface finish and compressive stress.

A workpiece holder, movably mounted within the enclosure, positions a workpiece so that its surface is transverse to the shot stream line. The holder construction enables the workpiece to be rotationally oscillated during peening. Such rotational oscillation of the workpiece allows uniform finishing of rather contoured pieces having characteristics like airfoils. It permits uniform finishes to be obtained over the entirety of such surfaces, whereas, the impingement angle of shot and resultant compressive stressing might be non-uniform in the absence of oscillation. Compared to apparatus in which the component is simply rotated, the oscillatory motion avoids impact of the shot on relatively fragile edges and the like.

In an embodiment of the invention for finishing an airfoil type workpiece, the angle of the workpiece holder, and thus the angle of the workpiece axis with respect to the shot streamline is variable. Thus, when articles such as airfoil components are peened, uniform finishes can be obtained even in regions where there are shoulders and the like.

Thus, in the preferred embodiment, three modes of airfoil workpiece rotation are possible: oscillation about an axis, incremental rotation about the same primary axis, and tilting of the axis. When the workpiece has fragile surfaces and two sides to be peened, as does a gas turbine airfoil, a diverter plate is utilized to intercept the shot stream before it hits the workpiece. When the shot is so intercepted it is possible to reposition the workpiece without impacts which could damage fragile surfaces. The diverter plate enables the continuation of shot flow through the gate. Thus when it is re-opened, steady state peening is immediately resumed.

Brief Descript:on of the Drawings

Best Mode for Carrying Out the Invention

Smooth surface finishes and uniform residual stresses are provided in workpieces using the method of a related application Ser. No. 300,725 "Method for Simultanous Peening and Smoothing", filed on even date hereof by the same applicants. In the method, hardened steel spheres, 1–2.5 mm dia, having substantially uniform diameters and energies are impacted on a workpiece. The disclosure of the related application is hereby incorporated by reference. Some embodiments of the present invention have relation to the applicants' copending application Ser. No. 300,718 "Method of Peening Airfoils and Thin Edged Workpieces".

Figure 1:
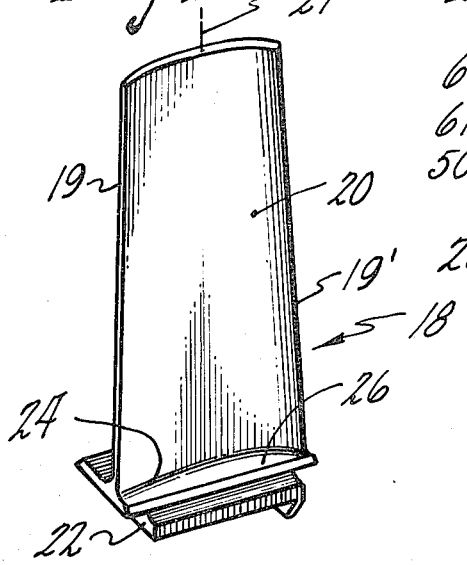
FIG. 1 shows a typical airfoil workpiece which may be processed in the apparatus of the invention.

The apparatus of the invention is particularly adapted for shot peening of airfoil type components used in the compressor of a gas turbine engine. One such typical part 18 is shown in FIG. 1. It is comprised of an airfoil section 20 and a root section 22. There is a transition fillet 24 between the airfoil section and the platform 26, or top surface of the root. The root 22 is tapered, to allow holding in another component of the engine. It is seen that the airfoil 20 has a curved shape and thin leading and trailing edges 19,19'. The opposing sides of the airfoil are usually of slightly different curvature. The principal, or longitudinal axis 27, of the airfoil goes through its length. It is notable that the platform 26 is at an angle, approaching 90°, to the general plane of the surface of the airfoil 20. To perform properly and resist fatigue, the part must be peened uniformly over the entire portions of the surfaces 20 and 24. The apparatus of the invention is adapted to do this.

Figure 2:
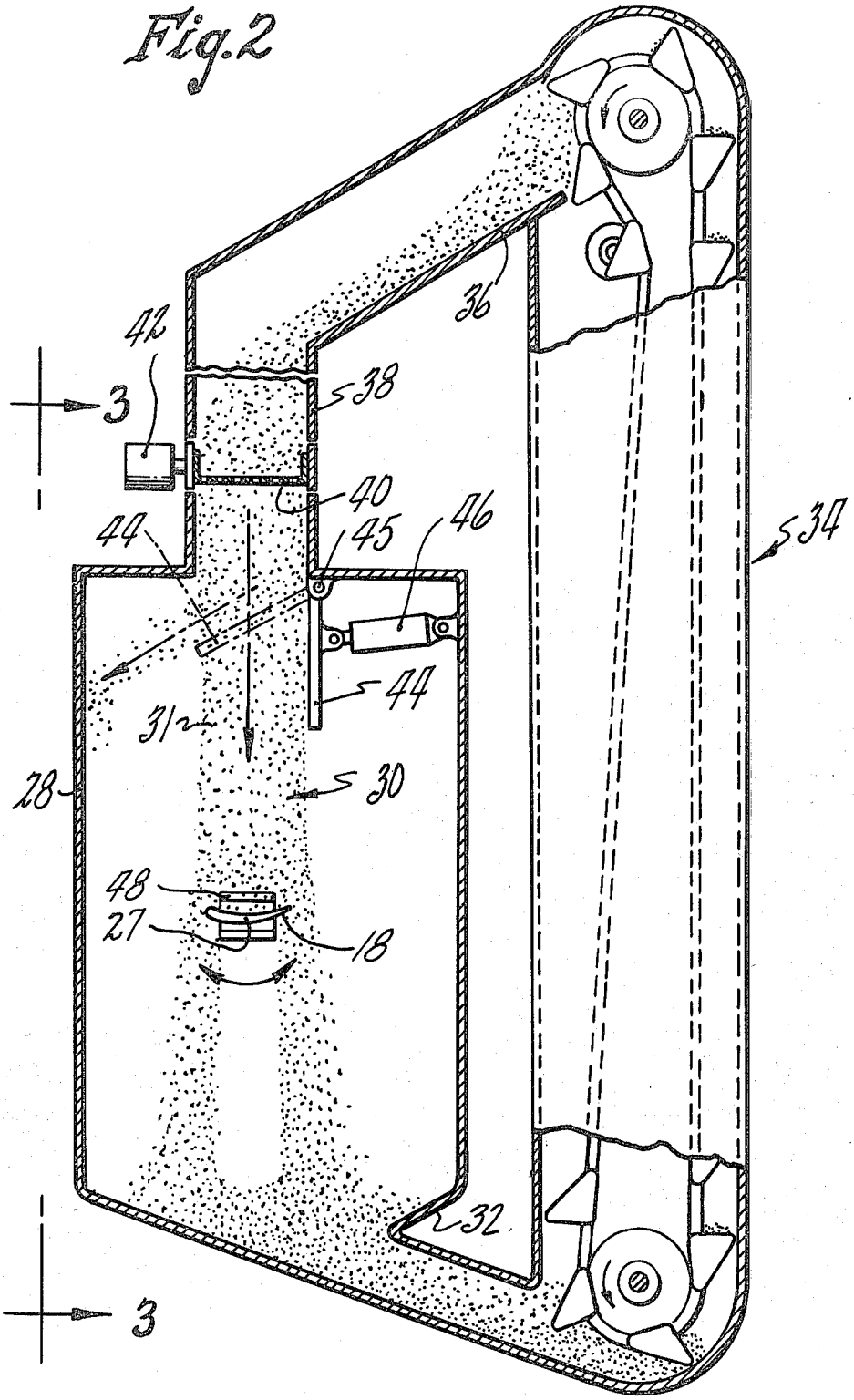
FIG. 2 is a cross-sectional elevation view of the apparatus showing the main enclosure and a bucket elevator.

FIG. 2 is a cross sectional view of the apparatus of the invention, showing an airfoil type workpiece 18 mounted within an enclosure 28. In operation, steel shot, such as uniform diameter 1.8 mm hard steel balls, falls from a height and impacts the workpiece by traveling along a streamline 31. The bottom of the enclosure 32 is adapted to receive the shot after it bounces off the workpiece, and conveys it to the bottom of a bucket elevator 34, or like device which is adapted to raise the shot to a height above the machine. The discharge chute 36 of the bucket elevator is connected to an upper chamber 38 mounted on top of the enclosure. Contained within the upper chamber is a gate 40, such as perforated plate, through which the steel shot must fall in order to enter the enclosure. The function of the gate is to bring the shot to essentially zero velocity, and to allow the shot to be discharged thereafter at an relatively low velocity. The particulars of the gate are described further below. A vibrator 42 is optionally attached to the upper chamber to assist in the passage of shot through the gate; in most instances it is not necessary. The gate is mounted vertically above the workpiece and is of such a dimension that the workpiece is uniformly covered by the shot which issues therefrom. (Alternately, there could be used means for translating the workpiece laterally under a smaller gate.) The gate 40 is movable in the vertical direction, so that the free-fall distance between the lower surface of the gate and the workpiece may be varied, to change the kinetic energy which the shot has when it impacts the workpiece.

Mounted in the upper part of the enclosure 28 is a diverter plate 44. The plate is rotatably mounted on pivot 45, so that it may be rotated across the shot streamline 31, to intercept the shot in its path towards the workpiece. The diverter plate is moved by an actuator, such as cylinder 46, when its use is desired. When the diverter plate is in its actuated position, as shown by the phantom view, the shot is diverted, as also shown in phantom, so that instead of traveling the streamline 31 toward the workpiece, it follows a path wherein it does not contact the workpiece. Of course, the diverter plate could be of various other configurations, and the shot could be caused to travel to the bottom of the bucket elevator by other paths than through the chamber. Activation of the diverter plate does not cause any of the shot to be retained on the gate, such as would occur if a sliding member simply blocked the bottom openings of the gate. This particular aspect is useful in avoiding accumulation of a head of shot on the gate, or beneath the gate, when shot peening of the workpiece is sought to be stopped. If such other modes of operation were possible, when the diverter (or analogous device) was deactivated, the shot which first issued toward the workpiece would not have the same energy and velocity as provided by the apparatus in its steady state operation. With the present apparatus any shot impacting the workpiece always has the uniform energy, as provided by the gate.

Figure 5:
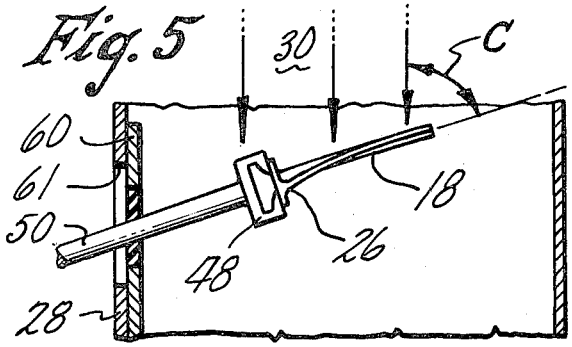
FIG. 5 shows a workpiece mounted transverse to the shot stream line within the chamber, positioned so that the impingement angle C is less than 90°.
Figure 3:
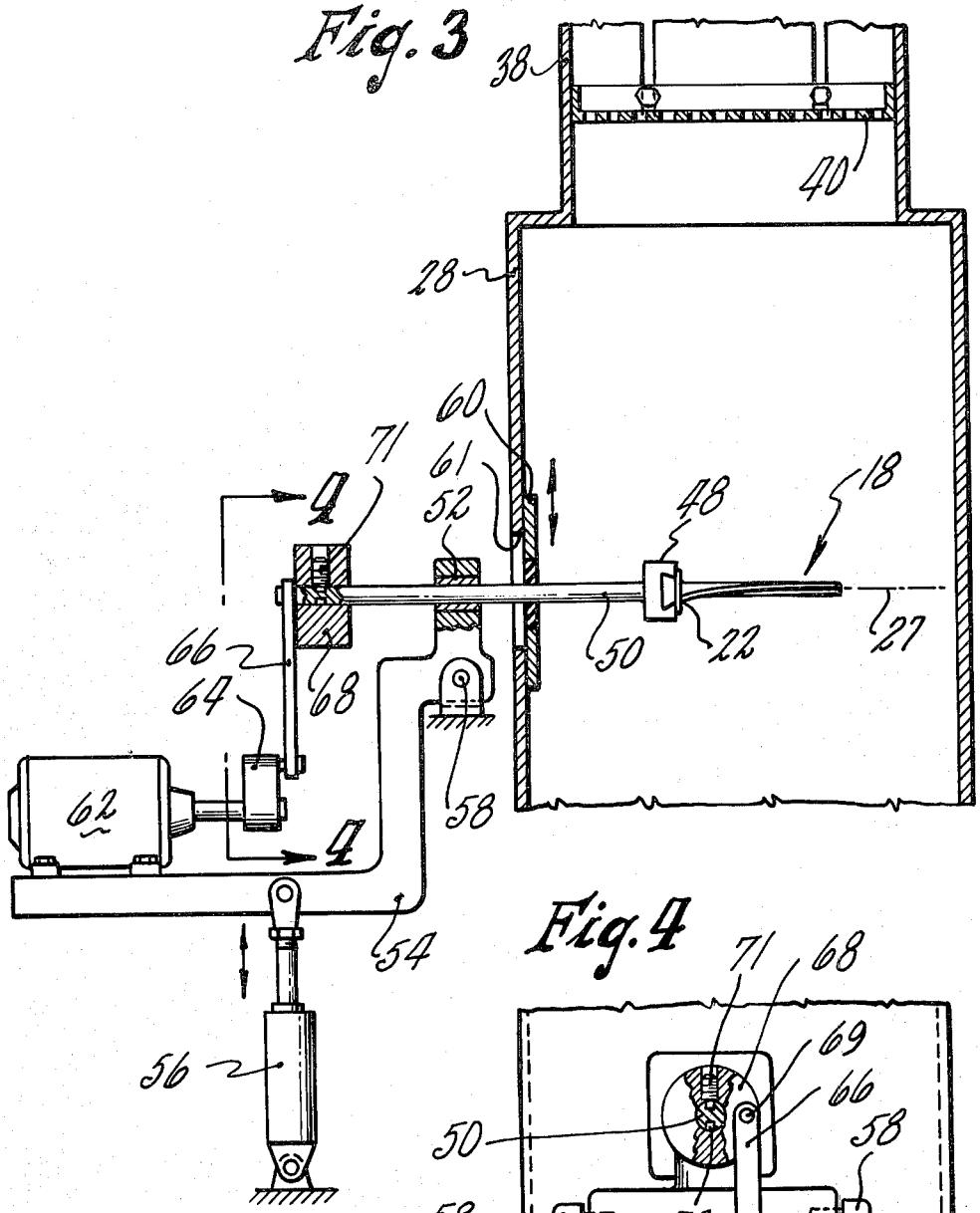
FIG. 3 is a side view of the apparatus of FIG. 2.

FIG. 3 shows further details of the apparatus. The workpiece 18 is mounted at its root 22 in a holder 48, attached to a rotatable shaft 50 mounted in a bearing 52, which is retained in the main bracket 54 of the workpiece holding mechanism. The bracket 54 is rotatable, when cylinder 56 is actuated, about its mounting pivots 58. Thus, when the bracket 54 is rotated, positively or negatively, it will be seen that the angle between the shot streamline and the workpiece shaft 50 (and the longitudinal axis 27 of the workpiece 18) will be varied. The workpiece is shown in FIG. 5 in a position obtained by negative rotation of its longitudinal axis. It may be seen from FIG. 5 that the angle of impingement, C, with the airfoil surface is thus decreased, while that with the platform is increased. (Impingement angles are by definition those less than 90°, between the workpiece surface and shot streamline.) When the support 54 is rotated, there is vertical motion of the shaft 50. To prevent shot from escaping, a slidable plate 60 surrounds the shaft 50, and translates along an opening 61 in the wall of the enclosure 28.

As described in the copending applications referred to above, the angle of shot impingement on a workpiece will usually be varied within the range plus or minus 20°; however, greater degrees of rotation, up to 45° may be desirable in certain instances. Practically speaking, large changes of the angle of impingement are only desired when it is necessary to adequately peen an area such as the fillet or platform. At high rotations, resultant low impingement angles on the airfoil will not produce efficient peening.

Figure 4:
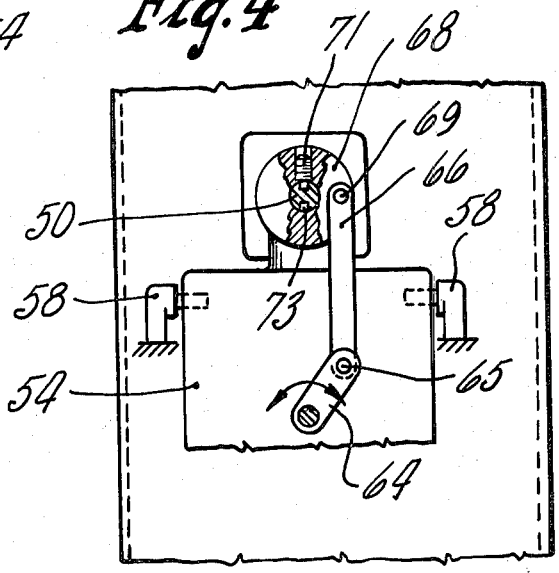
FIG. 4 is a partial end view of the apparatus for oscillating the workpiece, shown in FIG. 3.

As illustrated in FIG. 2, the apparatus provides for rotational motion of the workpiece about its longitudinal axis, by rotational motion of the shaft 50. There are two modes to this rotational motion. First, there is an oscillatory motion, provided by an eccentric drive system illustrated in FIGS. 3 and 4. Second, there is unitary rotation, to permit full rotation of the workpiece. For the oscillatory motion, it is seen that a motor 62 drives an eccentric arm 64 which, through pin 65, causes oscillatory motion of a link 66. The link in turn causes oscillatory motion through pin 69 to the collar 68 which is fastened to the shaft 50. Thus, it is seen that oscillatory motion of the workpiece will be achieved. The amplitude of this oscillation can be varied by changing the distance of the pins 65, 69 from their respective centers of rotation. The second mode of rotation of the shaft 50 and the workpiece is facilitated by the engagement of the shaft 50 with the collar 68. From FIG. 4, it is seen that the shaft is held to the collar, into which it slips, by means of a set screw 71. The shaft 50 is provided with two detents 73 at 180° apart. Thus, release of the set screw and rotation of the shaft by 180° will present the opposing side of the workpiece to the shot stream. Accordingly, it may be seen that in operation, the motor will oscillate the workpiece, as required to properly expose the contoured surface of the airfoil; and when sufficient peening is obtained on a first side of the workpiece, the motor is stopped, and the shaft and attached workpiece are rotated to expose the second side, whereupon oscillatory motion and peening may be re-commenced. It will be evident that other more refined mechanical apparatuses will carry out the aforementioned two modes of rotational motion.

Figure 6:
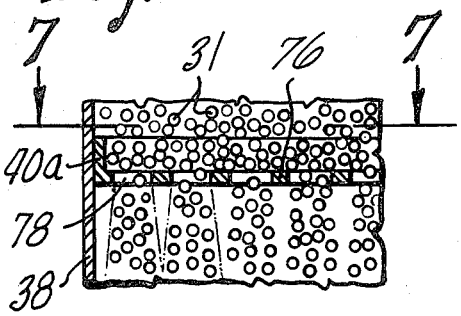
FIG. 6 is an elevation view of a gate in the upper chamber where the gate is a simple perforated plate, showing the shot pattern as it leaves the gate.
Figure 7:
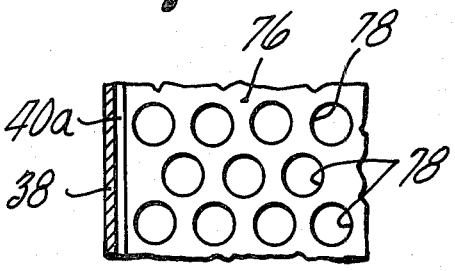
FIG. 7 is a top view of a portion of the gate of FIG. 6.

Referring again to the gate, FIG. 2 shows a simple orifice plate, such as a perforated plate with round or rectangular openings. A gate **40*a* of this design, made from a circular hole plate 76 is shown in FIGS. 6 and 7. Obviously, the openings 78** must be larger than the diameter of the shot. For shot which is 1.8 mm diameter, plates have been used which have circular openings of about 6 mm on 7.5–9 mm center spacing, with 59% open area. Another plate found useful has 3.9 mm openings on 4.7 mm center spacing with 62% open area.

If a single plate is used and the flow delivered by the elevator is less than that through the gate, it is possible for some shot to pass directly through the holes, without first hitting the plate. This means that such shot discharged from the gate will have a significant initial velocity. This is undesirable because it may result in variations in shot energy at the workpiece. The related method application describes the interdependency of workpiece finish and compressive stress on the shot mass and velocity. Predictability of saturation times is important for consistency in manufacturing; saturation time for any given shot mass and velocity is dependent on mass flow. Thus the gate should provide uniform shot flow.

Figure 10:
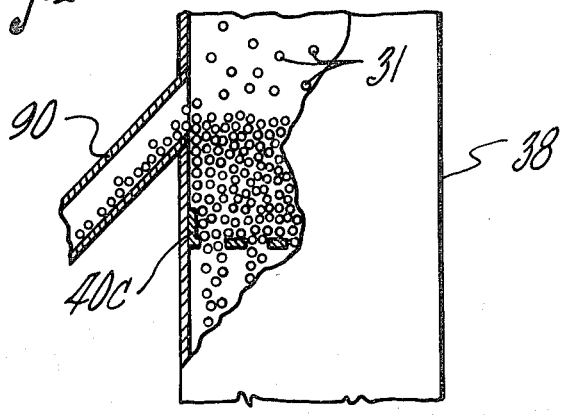
FIG. 10 shows an upper chamber which provides a constant head on the gate.

Therefore, the gate of our apparatus slows all the shot which passes therethrough, and provides it with a low and relatively uniform discharge velocity. One way of achieving the foregoing when the flow of shot to a single screen or plate exceeds the flow of shot therethrough, is to make provision for overflow, as shown in FIG. 10. Thus, a constant head H will be provided over the orifice plate. For the shot sizes of the invention herein, it is important that the head of shot be maintained at a level greater than about 10 cm. Experiment has shown that the flow rate of typical 1.8 mm diameter shot through a single orifice plate, such as the 6 mm opening plate mentioned above, increases significantly when the head is decreased below certain low values. Apparently, there is a decrease in shot packing and resistance to movement provided by a larger head. For heads greater than 10 cm, in the range 10–30 cm, there was no significant effect of head on flow rate for the shot and plates described herein.

Figure 8:
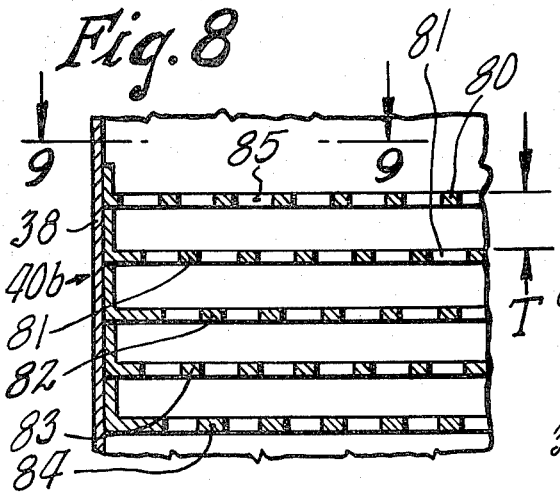
FIG. 8 is an elevation view, similar to FIG. 6, showing a gate comprised of multiple perforated plates.
Figure 9:
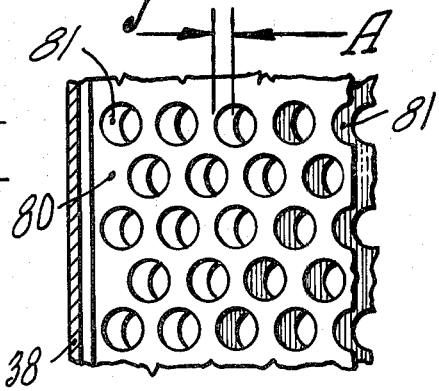
FIG. 9 is a partial top view of the gate in FIG. 8.

Another manner of achieving the desired low initial velocity is the labryinth or step gate shown in FIGS. 8 and 9. The gate **40*b* has a series of five spaced apart perforated plates 80–84 which are offset a distance A from one another. The size of the holes 85** in the perforated plate may be varied for a particular shot size. For 1.8 mm dia. shot, 12 mm dia. holes are suitable. The center of the holes are 15–22 mm apart and the plate is 36 percent open area. The 1.5 mm thick plates are spaced apart a distance T, which is about 6 mm. The overall gate thickness is about 32 mm. The offset A is about 4 mm. The offset may vary in degree and direction from that shown, but it must insure that the shot will not pass directly through the gate, and instead follow a torturous zig-zag course. The number of perforated plates and their exact spacing and dimension may be varied somewhat, in carrying out these objects. While perforated plates with circular openings have been described, it should be evident that other types of plates with different shaped openings will be able to carry out the invention.

The step gate is rather insensitive to head on the first or uppermost plate, although it is generally preferable that there be zero head. This may be achieved by having the capacity of the bucket elevator less than the flow through the gate. As will be evident from the drawing, shot cannot directly pass through the step gate. It must hit at least one of the last three plates and have its vertical motion brought to zero. Also it will be apparent that the shot falling onto and through the last plate will necessarily have a lateral velocity component.

Even with the single perforated plate the shot is observed to have a lateral discharge velocity, as the shot moves laterally across the closed area of the plate and into the openings. The provision of a small lateral velocity component to the shot is important. If a uniform shot stream pattern is provided then the workpiece does not have to be translated about the shot stream to obtain uniformity, as would be required if shot issued from a series of funnels, or in a pattern size smaller than the workpiece. In an actual construction of our invention, the workholding zone is about 0.15 by 1.5 m, and holds twenty typical blade workpieces side by side, in the manner illustrated in FIG. 3. Within such a workholding zone we must have a uniform shot stream, provided by a gate which has a total area equal to the workholding zone.

Our calculations and observations indicate that the initial or gate discharge velocities of shot described below vary from about 0.22–0.53 m/sec., as determined when the shot center passes the bottom plane of the gate. Careful observation shows that 1.8 mm shot issuing from the separate openings or discharge points of the 6 mm opening plate mentioned above merges about 0.125 m below the plate, as indicated in FIG. 6. This constitutes a lateral velocity of about 0.08 m/s. The initial lateral velocity is from 15–35% of the initial vertical velocity but when related to typical final (impact) velocities, of the order of 2.4–7.8 m/s, it is seen that the lateral component (which is hypothetically unchanged) is only about 1–3%, meaning that it is negligible and the shot is essentially traveling along a collimated path.

The steel shot which is used in our invention has a diameter in the range 1–2.5 mm. Cost and availability considerations lead to shot which is about ±0.05 mm from the mean dimension. The 1–2.5 mm dia. particles will range in volume between $0.52–8.2\times10^{-9}m^3$ and in mass between $4–64\times10^{-3}$ gm. The shot particle mass will vary up to about ±17% in a particular size, depending on the mean diameter, notwithstanding the close diameter tolerance set forth above. Nonetheless, those familiar with the art will recognize the shot tolerances are indeed close.

Flow rates in the practice of our invention typically are of the order of 80–110 kg/sec/$m^2$ of work zone area, and these are effective in giving saturation times of the order of 60–600 seconds, depending on shot peening intensity, shot size, etc.

Figure 11:
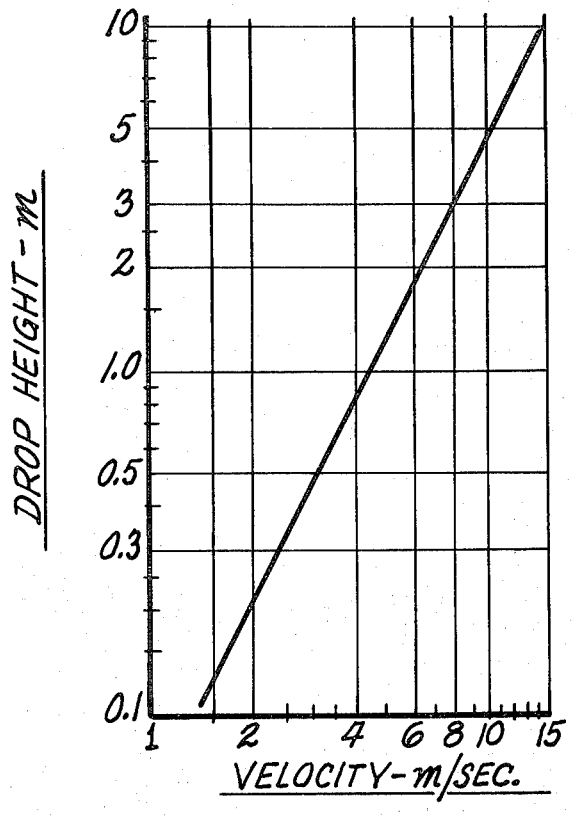
FIG. 11 shows the relationship between drop height and velocity.

The spacing between the gate and the workpiece, the drop height h, will determine the velocity v of the shot, according to the familiar relationship $v^2=2$ gh. FIG. 11 shows the velocity for various heights in the invention. For a given peening intensity, smaller shot necessitates greater height, since peening intensity is a function of the kinetic energy of the shot at impact. In the inventive method of surface finishing, relatively large shot sizes and relatively low peening intensities are used, as disclosed in copending applications. Large shot sizes mean the gate must be located relatively close to the workpiece when moderately low peening intensities are used.

In both instances there are practical limits. Too great a spacing becomes impractical insofar as the dimensions of the apparatus are concerned. We consider drop heights in excess of 3–6 m to be impractical. Too small a spacing creates significant variations in peening intensity, both due to any gate discharge velocity differences and changes in elevation caused by the rotation of the workpiece longitudinal axis. For example, at 0.3 m height, the variation in impact velocity produced by a shot initial velocities variously at 0.2 or 0.5 m/sec will be 2%; at 0.6 m height, the variation is less than 1%.

Referring to FIG. 11, and taking into account the initial velocity variations and workpiece height variation, we consider a drop height, h, less than 0.6 m unpreferred and would avoid height less than 0.3 m. Thus, our drop height range of 0.3–6 m has associated with it impact velocities of about 2.5–12 m/sec, while our preferred range of 0.6–3 m has associated with it impact velocities of about 3.5–8 m/sec. As indicated in the referenced copending method applications, the foregoing velocity ranges are critical to good simultaneous peening and smoothing.

By analogy with the shot size tolerances, it is permissible that the velocity at impact may vary by about ±4% (Thus, the square of the velocity, which affects energy at impact, will be uniform within about ±16%) The velocity, of course, is independent of shot size, and in our invention is influenced only by the gate characteristics and the drop height.

With the foregoing mass and velocity tolerances and ranges, it will be found that our invention provides unit shot impact energies in the range of $0.2\times10^{-4}$ to $12\times10^{-4}$J, ±25%.

The operation of the invention has in part been described above. In summary, a workpiece is inserted into the workpiece holding zone (defined as the region within which the workpiece may move in its holder and receive shot impact) through a door (not shown) in the side of the main enclosure. The workpiece is positioned so that the shot impingement angle will be that which experiment has shown necessary to properly finish a surface, such as the platform 26. The longitudinal workpiece axis may be rotated during peening, to vary the impingement angle. However, in many airfoils a single fixed angle in the range 5–15 degrees is adequate to peen an airfoil and its fillet.

Oscillation of the airfoil is commenced; typically it will be of the order of 20 cycles per minute, in the context of a typical peening time of about 2–3 minutes per side. Oscillation angles and practice should be in accord with the teachings of copending application Ser. No. 300,718 "Method of Peening and Thin Edged Workpieces", filed on even date herewith, the disclosure of which is incorporated by reference. Typically, an airfoil will oscillate through a ±20° angle.

The elevator is started and shot is carried to the upper chamber, thence passing through the gate, and falling on the workpiece. The flow of shot will be that which is desired to obtain shot peening saturation in an economic time. Flow rates that are too "high" should be avoided since "blind spots" of low I are created in the centers of workpieces, due to apparent interference between the shot particles attempting to escape from the workpiece surface.

The peening action is continued until experiment shows that the workpiece has obtained the desired coverage. Thereafter, the diverter plate is actuated to stop the flow of shot toward the workpiece, and the workpiece is quickly rotated to a position 180° from its original position, to expose its second side. The shot flow is diverted during rotation, to avoid unwanted impact on the fragile edges 19, 19' of the airfoil. As soon as the workpiece is rotated, the diverter plate is deactivated and the shot flow re-commences along the main streamline. Of course, in the previously described steps instead of using the diverter plate, the bucket elevator could have been stopped, with the same effect as terminating the shot stream flow. However, the diverter plate provides a quicker and much more efficient method, and avoids the possibility of any stray shot impinging on and possibly damaging the workpiece. It should be evident that the diverter plate could be configured differently, and located elsewhere to carry out the described function. It is also possible in the practice of the invention to close the diverter plate entirely to stop the flow of shot. This will cause an accumulation of shot on the plate, beneath the gate. When the plate is opened, it is opened slowly, to allow the accumulated shot to fall without directly hitting the workpiece, and to enable resumption of the steady state flow. After this is achieved, the plate is fully opened.

After a period of time similar to that used for the first side of the workpiece, the flow of shot is again interrupted by means of the diverter plate or stopping of the elevator. The workpiece is then removed from its holder and a new part inserted in its place.

It will be seen from the foregoing that other than the small lateral component which diminishes in significance as velocity increases nearer the workpiece, the shot will travel along an essentially collimated streamline, falling vertically. That the apparatus be adapted to provide shot traveling at substantially uniform velocity along a straight streamline is much preferred in the operation of the invention, since it produces known energies and in the case of uniform sized shot, uniform energies. As indicated, gravity of earth is the preferred means for accelerating the shot. However, other means of accelerating shot uniformly are not precluded, including mechanical devices such as slingers and the like, specially constructed rotary impellers (it being known that uniform velocities are typically not obtained in commercial impeller type machines), and magnetic devices.

To continuously obtain good peening in accord with the objects of the invention, the apparatus must be constructed so that it does not damage the shot in its processing. To achieve this, it is desirable that the interior parts of the enclosure be lined with a thermoplastic, to cushion the impacts of the shot, especially shot which passes by the workpiece. Also, the bucket elevator or other means by which shot is circulated should be constructed to do no harm to the shot. The uniformity of shot peening within the apparatus may be monitored by a suitable instrument adapted to measure peening intensity.

Although this invention has been shown and described with respect to a preferred embodiment, it will be understood by those skilled in the art that various changes in form and detail thereof may be made without departing from the spirit and scope of the claimed invention.

We claim:

1. Apparatus for shot peening a workpiece comprised of an enclosure for containing shot moving along a streamline, means for recirculating shot, a holder mounted within the enclosure to position a workpiece in a workpiece holding zone along the shot streamline, and means for discharging shot into the enclosure at a low vertical velocity from a multiplicity of openings located vertically above the workpiece holding zone, to enable the discharged shot to be accelerated by gravity toward the workpiece holding zone; characterized by discharge means providing to the shot a small lateral velocity component, to cause the shot discharged from the multiple points to merge to a substantially uniform stream, so that a workpiece is evenly impacted by the shot without the need for lateral movement thereof; a movable holder adapted to position a workpiece so that a first axis is transverse to the shot streamline; and means for rotationally oscillating the workpiece about the first axis.

2. The apparatus of claim 1 further characterized by means for rotating the first axis of the workpiece in space, to vary the angle between said axis and the shot streamline.

3. The apparatus of claim 1 further characterized by means for discharging shot into the chamber which comprises at least one perforated plate.

4. The apparatus of claim 3 further characterized by a means for discharging shot which includes a horizontal perforated plate, whereupon lateral motion of shot on the surface of the perforated plate provides the desired lateral initial velocity component.

5. The apparatus of claim 3 further characterized in that the perforated plate is vertically adjustable in position, to vary the distance through which shot may fall before passing through the workpiece holding zone.

6. The apparatus of claim 1 further characterized by means for diverting the shot from its streamline, to protect the workpiece from the shot impact without ceasing the flow of shot through the multiplicity of openings.

7. The apparatus of claims 3 or 4 further characterized by shot discharging means which is comprised of a series of spaced apart perforated plates having offset hole patterns.

8. The apparatus of claim 3 wherein the shot recirculating means has a capacity no greater than the capacity of the shot discharge means, to avoid accumulation of shot above the discharge means.

9. The apparatus of claim 3 further characterized by means for maintaining a constant head of shot over the perforated plate.

10. The apparatus of claim 8 further characterized by a perforated plate adapted to discharge 1–2.5 mm dia shot and constant head maintaining means which provides a head of shot in the range 10–30 cm.

11. The method of shot peening a workpiece having two surfaces meeting at a thin edge using a substantially collimated stream of gravity accelerated shot discharged from a gate and traveling as a stream along a streamline path toward the workpiece, characterized by exposing a first workpiece surface to the shot stream to peen the surface; then momentarily diverting the shot emanating from the gate from its streamline path to cause the shot to continue its travel along a second path directed away from the workpiece without accumulating therealong, while repositioning the workpiece to expose the second workpiece surface to the shot stream; ceasing the diversion of shot and peening the second surface; to thereby peen both surfaces without injuring the thin edge by direct exposure to the shot.

12. The method of claim 11 characterized by oscillating the workpiece during the times the first and second surfaces are peened by exposure to the shot stream.

* * * * *